US006428451B1

(12) United States Patent
Hall

(10) Patent No.: US 6,428,451 B1
(45) Date of Patent: Aug. 6, 2002

(54) ROTATABLE PEDESTAL

(76) Inventor: Albert J. Hall, 2540 Ranchwood Ct., Melbourne, FL (US) 32934

( * ) Notice: Subject to any disclaimer, the term of this patent is extended or adjusted under 35 U.S.C. 154(b) by 0 days.

(21) Appl. No.: 09/611,694

(22) Filed: Jul. 7, 2000

(51) Int. Cl.[7] ..... A63B 22/16

(52) U.S. Cl. ..... 482/146; 482/147; 482/79; 482/80

(58) Field of Search ..... 482/146, 147, 482/79–80, 121–130, 111–113

(56) References Cited

U.S. PATENT DOCUMENTS 3,604,722 A * 9/1971 Boley ..... 280/87.01
4,193,592 A * 3/1980 Bishow ..... 272/114
4,848,742 A * 7/1989 Lindley et al. ..... 482/142
4,989,860 A * 2/1991 Iams et al. ..... 482/132
5,366,430 A * 11/1994 Yao ..... 482/147
5,368,536 A * 11/1994 Stodgell ..... 482/79
5,399,140 A * 3/1995 Klippel ..... 482/146
5,755,651 A * 5/1998 Homyonfer et al. ..... 482/146
5,766,119 A * 6/1998 Clark ..... 482/146
5,879,276 A * 3/1999 Miller ..... 482/146

* cited by examiner

*Primary Examiner*—Jerome W. Donnelly
*Assistant Examiner*—Lori Baker Amerson
(74) *Attorney, Agent, or Firm*—Brian S. Steinberger; Law Offices of Brian S. Steinberger, P. A.

(57) ABSTRACT

A rotatable pedestal for allowing single riders such as a child to use their body weight to cause a rotatable disc seat to rotate over a sloped surface on a support stand. Springs within the stand cause the seat to rotate in an erratic and jumpy manner while the seat goes from a horizontal position to tilted positions of up to approximately 20 degrees and back to a horizontal positions. The pedestal is small enough and light enough to be portable and strong enough for most children up to the age of approximately 12 years old.

11 Claims, 7 Drawing Sheets

Fig. 8B
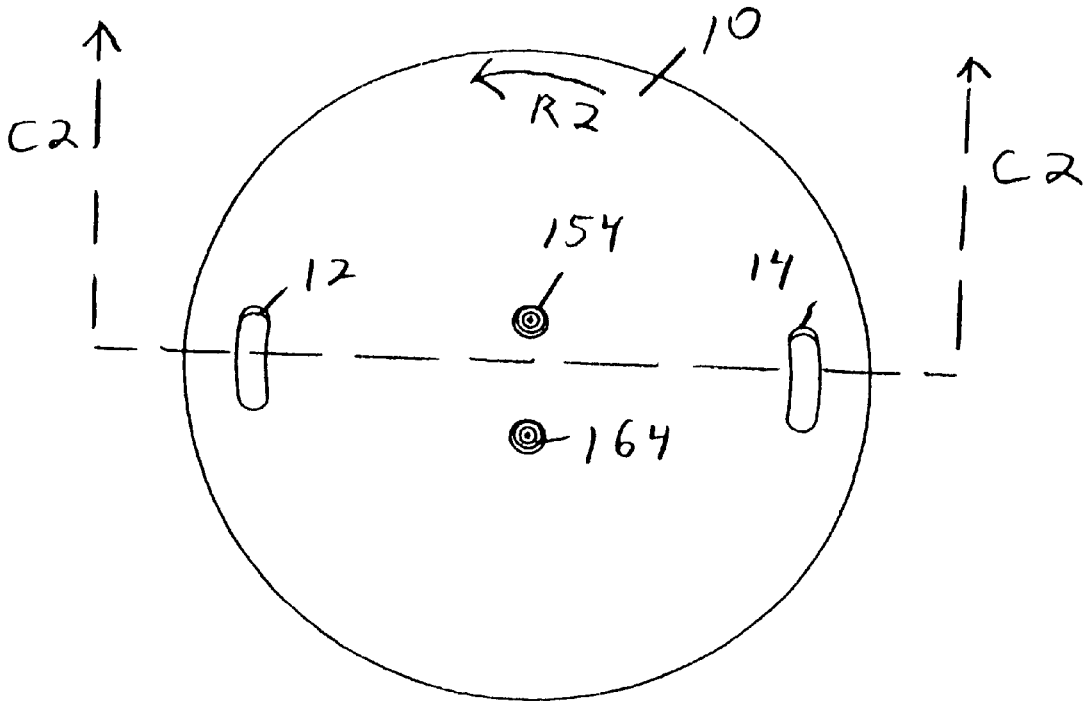
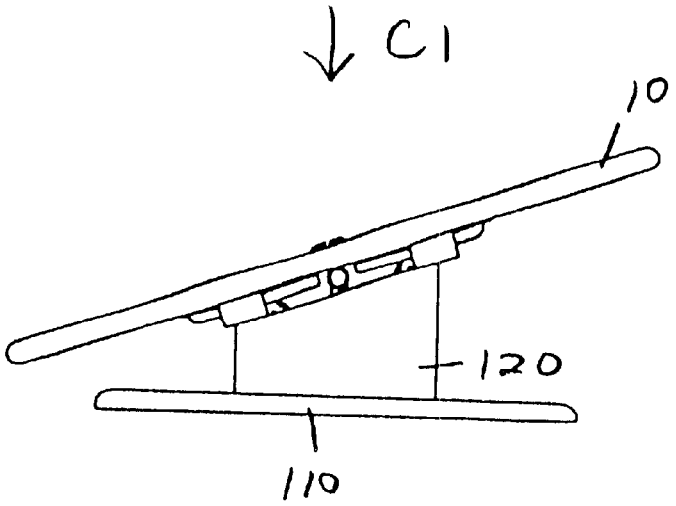
Fig. 8A

ROTATABLE PEDESTAL

This invention relates to toys, and in particular to a rotatable pedestal toy having a disc seat with handles for supporting a child that rotates over an uneven surface of a base allowing the child to tilt up and down while spinning in a circle.

BACKGROUND AND PRIOR ART

Children enjoy spinning about in circles for fun and have tried to enjoy this pleasure by either spinning about in circles or using some type of device to get the effect. For example, children have been known to spin around using chairs with swivel bases. However, most chairs are intended for office type use and are not intended to be used as a playtoy. For example, most toys have a back support or both a back support and armrests, and are intended by their use to be used with tables. Additionally, it can be dangerous to spin on chairs where the rotating causes the chair to disengage from the base. Thus, chairs with swivel bases are not a practical device for children to play on.

It is known that many community playgrounds have rotatable equipment for children to play on. However, these types of playground equipment can generally, be large, heavy and expensive devices that must be permanently anchored to the ground in order to be used. Additionally, these types of playground equipment are generally limited to only allowing the child to rotate in one horizontal plane always being continuously parallel to the ground. Thus, the large cumbersome playground equipment would not be suitable for a single child to play on, and would not be portable, and would also not be inexpensive enough to be sold in most stores.

SUMMARY OF THE INVENTION

The first objective of this invention is to have a rotatable pedestal that allows a single child user to rotate in a horizontal uneven plane.

The second objective of this invention is to have a rotatable pedestal for children that is both portable, lightweight and inexpensive to manufacture.

The third objective of this invention is to have a rotatable pedestal for children having a flat surface seat area with handgrips inside the seat but without upright armrests nor backing.

A preferred embodiment of the rotatable pedestal includes a base stand having an upper uneven edge surface and a lower ground engaging surface, and a seat attached to the base stand where the seat rides over the uneven surface edge going from a horizontal position to a tilted position and back to a horizontal position and back to a tilted position as the seat rotates relative to the base stand. The uneven surface edge can be a sloped surface having an upper height of approximately 4.5 inches and having a lower height of approximately 2.5 inches. The angle of tilt can take the rider from a level position to a tilted position of approximately 20 degrees to approximately 30 degrees. The seat can ride over the uneven surface edge of the base stand by two wheels such as rollers that can have rubber surfaces for creating a cushion effect. The seat can be attached to the base stand by having a t-post that has upper arms that pivot to cylindrical gimbal type housing fastened beneath the seat. The longitudinal leg of the post can rotate to and be connected to the axis of the base stand by bearings, and the like.

Elastic members such as springs having one end connected to the longitudinal leg of the post stand and opposite ends attached beneath the seat alternate between a compressed position and a stretched position as the rider is rotating. A rider starts the rotation of the seat by leaning to one side. Thus, putting body weight on the rollers causes the rollers to roll down the slope causing the seat to rotate at the same time. Inertia causes this motion to continue so that the original momentum allows the rolling to continue rolling up the upward slope portion. When the rolling begins to slow down, the rider can lean to the opposite side to continue rolling in the same rotational direction. Alternatively, the rider can continue leaning to the same side during the ride. This would cause the rotation to reverse. Thus, the ride can have a roller coaster effect. The stretching and compressing of the springs allows the pedestal to return to a level position when not in use. The seat can be disc shaped with side through-holes that act as handgrips for the rider. The pedestal is small enough and light enough to be portable and strong enough for most children up to the age of approximately 12 years old.

Further objects and advantages of this invention will be apparent from the following detailed description of a presently preferred embodiment which is illustrated schematically in the accompanying drawings.

BRIEF DESCRIPTION OF THE FIGURES

FIG. 8A shows a side view of the loaded down tilted pedestal of FIGS. 6B and 6D.

FIG. 8B is a top view of the pedestal of FIG. 8A along arrow C1.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
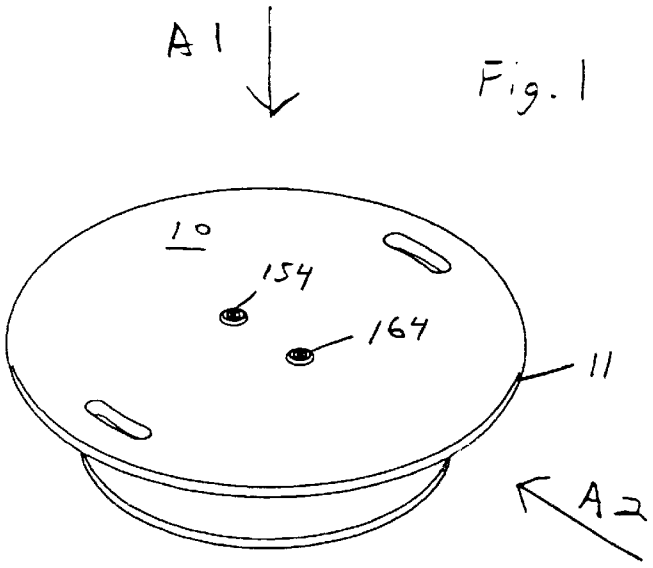
FIG. 1 is a perspective view of the rotatable pedestal invention.
Figure 2:
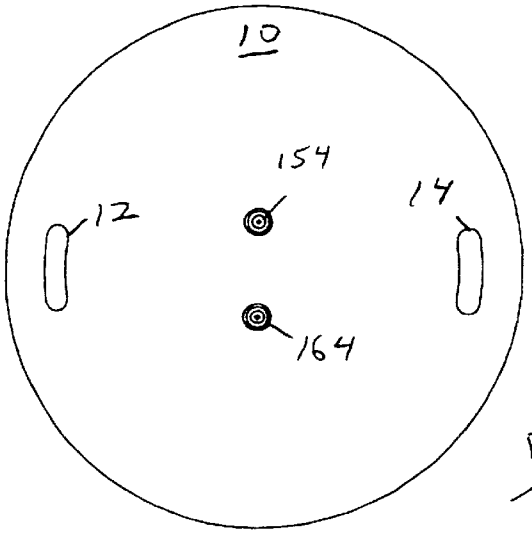
FIG. 2 is a top view of the rotatable pedestal of FIG. 1 along arrow A1.
Figure 3:
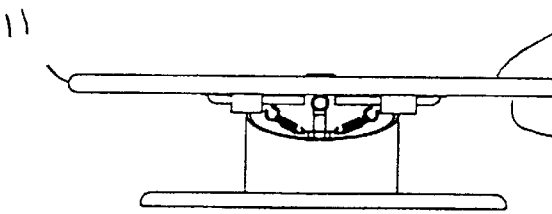
FIG. 3 is a front view of the rotatable pedestal of FIG. 1 along arrow A2.
Figure 4:
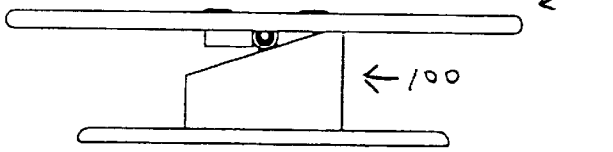
FIG. 4 is a side view of the rotatable pedestal of FIG. 1 along arrow A3.

FIG. 1 is a perspective view of the rotatable pedestal 1. FIG. 2 is a top view of the rotatable pedestal 1 of FIG. 1 along arrow A1. FIG. 3 is a front view of the rotatable pedestal 1 of FIG. 1 along arrow A2. FIG. 4 is a side view of the rotatable pedestal 1 of FIG. 1 along arrow A3.

Figure 5:
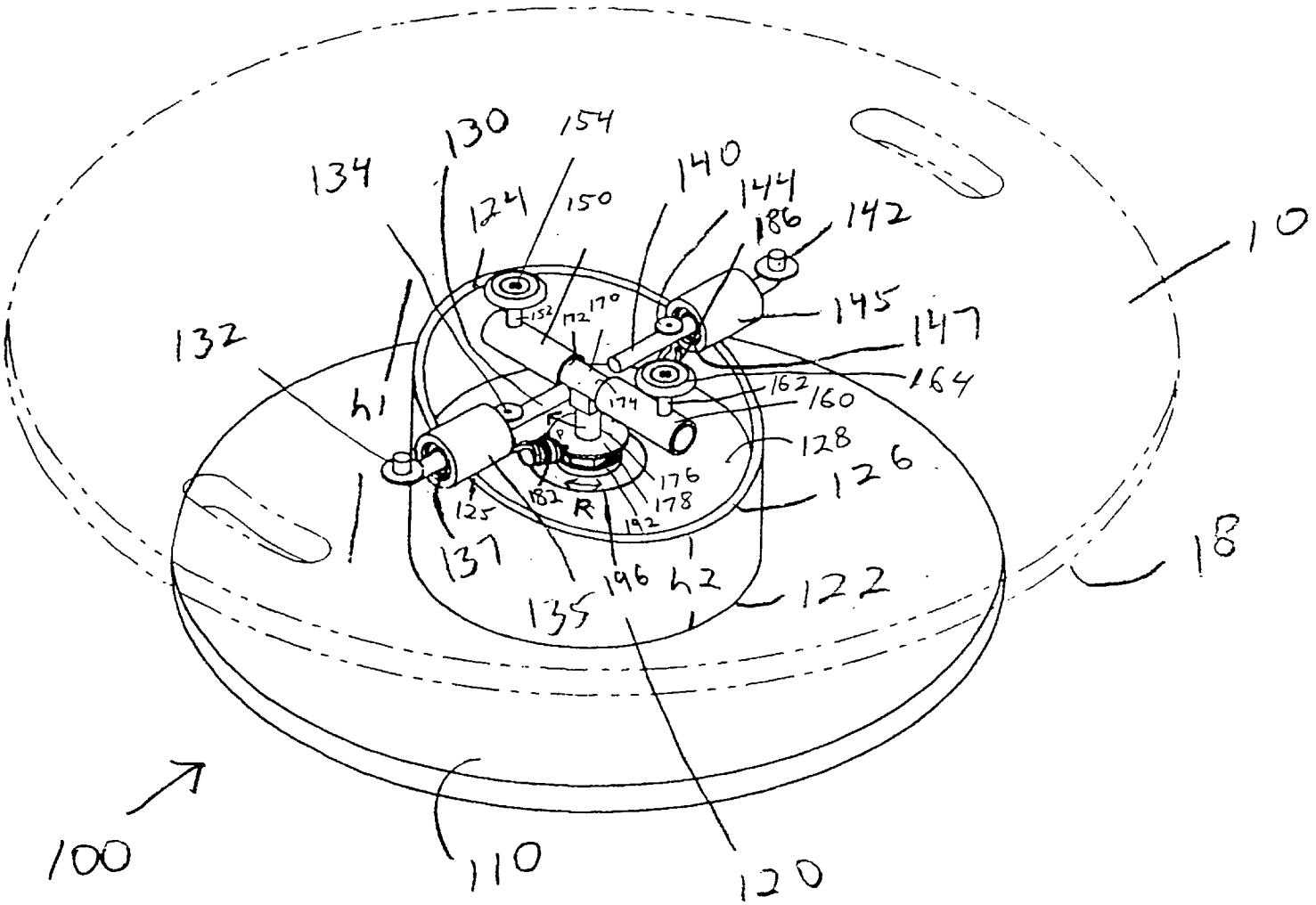
FIG. 5 is an enlarged perspective view of the swivel, tilt components in the base of FIGS. 1–4.

FIG. 5 is an enlarged perspective view of the swivel and tilt components 200 in the base 100 of the rotatable pedestal 1 of FIGS. 1–4.

Referring to FIGS. 1–5, rotatable pedestal 1 includes a disc shaped seat 10 rotatably attached to a base 100 by swivel and tilt components 200. Seat 10 can be disc shaped having dimensions of approximately 21 inches in diameter and approximately ¾ of an inch thick, concave rounded edges 11, an upper planar seating surface 16, and a lower planar surface 18, and include two arcuate shaped through-hole slots 12, 14 with rounded interior edges, each being approximately 4 inches in length and 1 inch wide for use as handgrips for a rider.

Base 100 includes a ground coupler 110 which can also be disc shaped having dimensions of approximately 15 inches in diameter and approximately ½ inch thick. A raised hollow cylindrical stand 120 with flat bottom end 122 attached to the center of the ground coupler 110. The cylindrical stand 120 can be approximately 6 inches in diameter and have an uneven upper edge surface that can be sloped with a height ranging from a high point 124 height, h1 of approximately 4.5 inches to a low height, h2 of approximately 2.5 inches, with a edge portion 125 approximately midway between high and low heights, h1 and h2.

Referring to FIG. 5, attached to lower planar surface 18 of the seat 10 to be suspended below the seat 10 are two axles 130, 140 which are fixable attached to surface 18 by fasteners 132, 134, 142, 144, such as but not limited to bolts, screws, and the like. About each of the axles 130, 140 are freely rotatable rollers 135, 145, respectively. Between each of the rollers 135, 145 and their respective axles 130, 140 can be internal bearings 137, 147. The rollers 135, 145 can be formed from hardened plastic, and the like. Additionally, the exterior surface of the rollers can be formed from a rubber type material to act as a cushion, shock absorber effect, for the rider on the seat 10. The axles 130, 140, bearings 137, 147, and fasteners 132, 134, 142, 144 can be formed from metal such as aluminum, galvanized metal, and the like. The operation of the rollers 135, 135 and their related components will be described later in detail in reference to FIGS. 7A–8C.

Figure 7C:
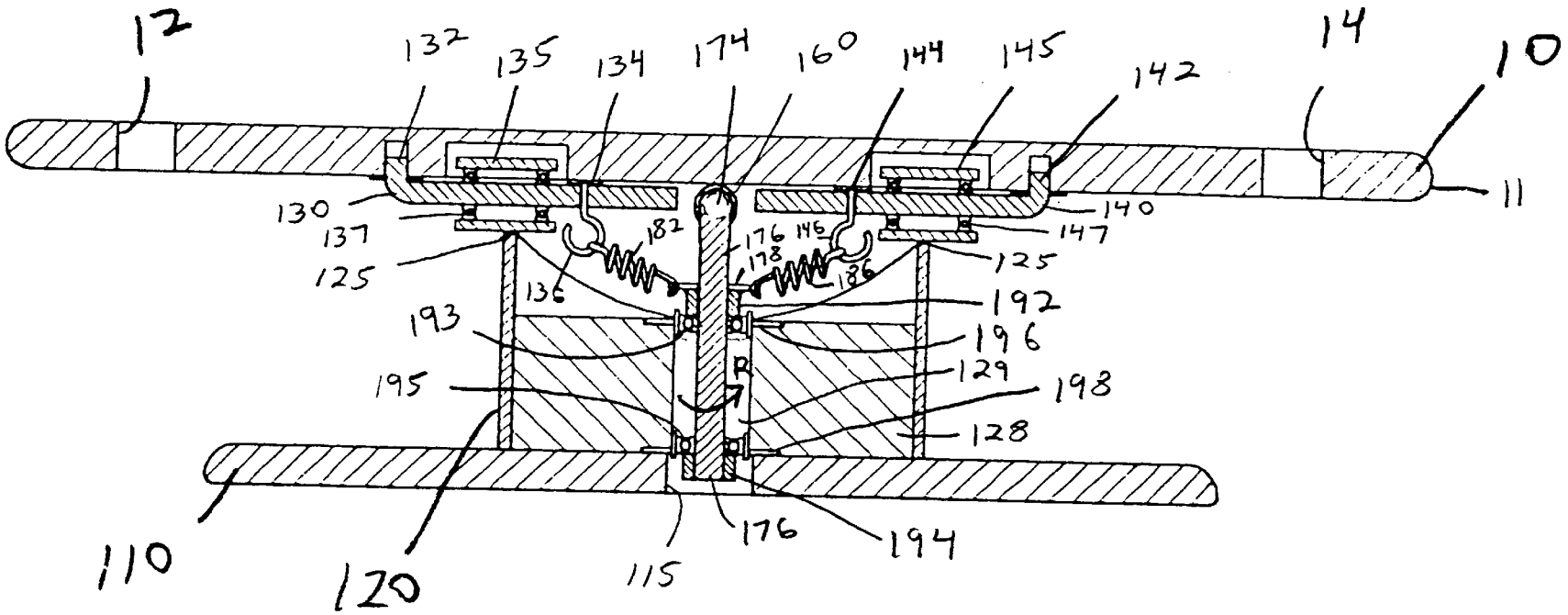
FIG. 7C is an enlarged side cross-sectional view of the pedestal of FIG. 7A along arrow B2.
Figure 8C:
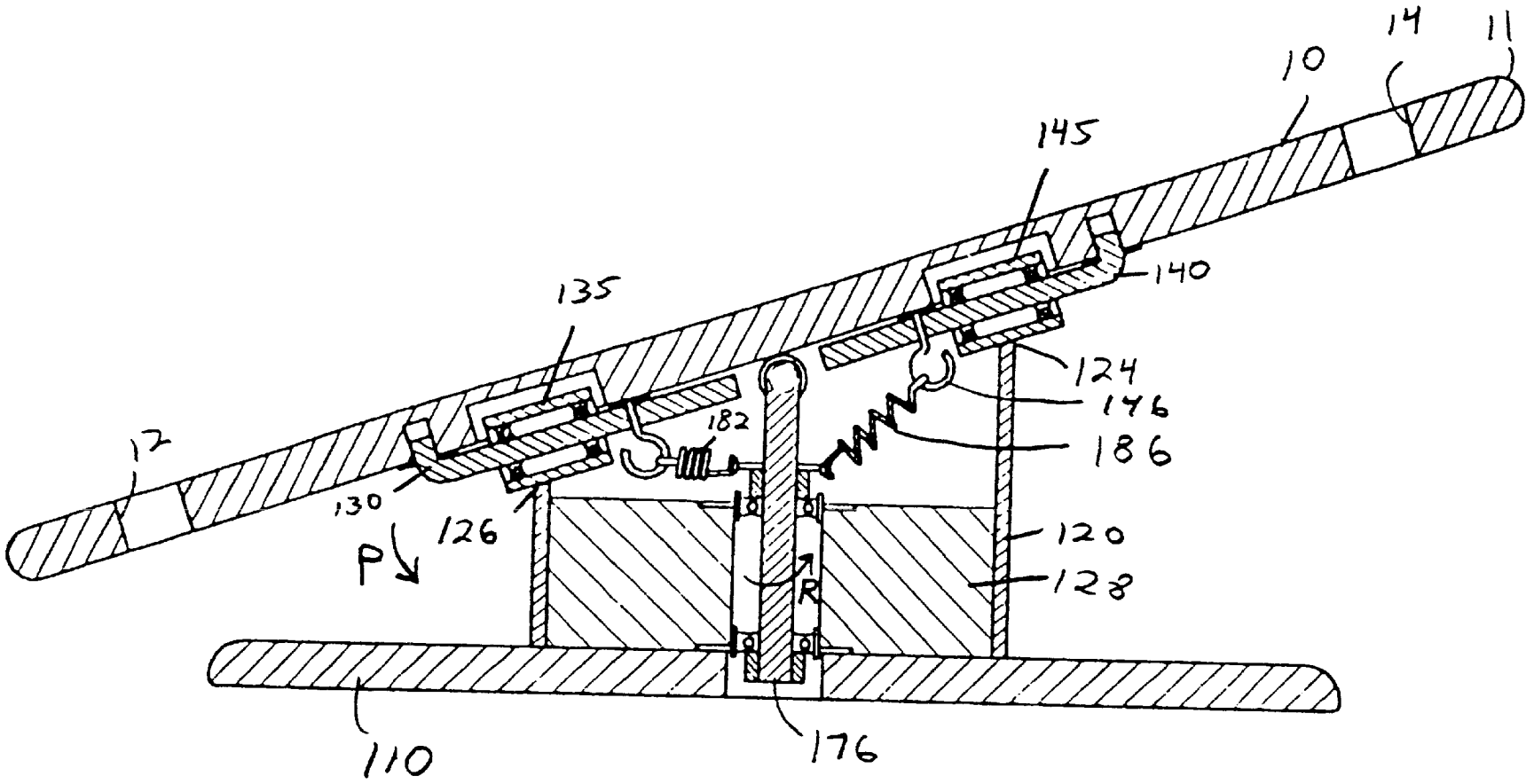
FIG. 8C is an enlarged side cross-sectional view of the pedestal of FIG. 8A along arrow C2.

Referring to FIG. 5, two hollow cylindrical gimbal bushing housings 160, 150 are fixably attached to the lower surface 18 of the seat 10 by hollow stem supports 152, 162, the latter having internal walls with threads for mateably receiving threaded screws from fasteners 154, 164. Fasteners 154, 164 can be flat headed screws having heads which can be counter sunk through the upper planar seating surface 16. The axes of cylindrical housings 160, 150 are positioned in a cross pattern to roller axles 130, 140. Inside each of the cylindrical housings 160, 150 are the upper arms 172, 174 of T-shaped gimbal post 170. The axles 130 and 140 alternate pivoting toward post 176 in the direction of arrow P, such that the axles 130, 140 pivot relative to cylindrical housing 160. In other words, the lower leg 176 of post 170 appears to be able to pivot in the direction of arrow P either toward axle 130 or toward axle 140. Thus, the angle of rotation of post 170 is perpendicular to angle of rotation of rollers 135, 145. Fixably attached to post leg 176 is a spring mount coupler 178, which can be welded thereon, and the like. Connected to opposite edges of mount coupler 178 are spring members 182, 186(which are more clearly shown in reference to FIGS. 7C, 8C). The spring members 182, 186 are also connected at opposite ends to axles 130, 140. Fixably attached to post leg 176 underneath coupler 178 is a post bearing washer 192(a second 194 is shown in FIGS. 7C, 8C). Post leg 176 passes through a gimbal type support housing 128 located inside of cylindrical housing 120. Fixably mounted to support housing 128 is a first support bearing washer 196(a second support bearing washer 198 is shown in FIGS. 7C, 8C). Post leg 176 with coupler 178 and first post bearing washer 192 can rotate in the direction of arrow R relative to first support bearing washer 196 and support housing 178 by bearings 193, 195(shown in greater detail in FIGS. 7C, 8C). The internal detail of support housing 178, post leg 176, post bearings 192 and bearing washer 194 are shown in greater detail in reference to FIGS. 7C and 8C.

Figure 6A:
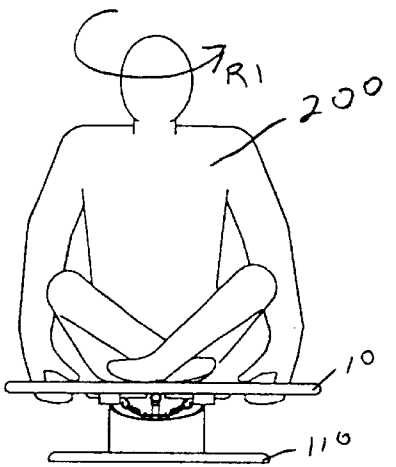
FIG. 6A shows a rider on the rotatable pedestal in the front view position of FIG. 3 at 0 degree rotation and initial level orientation.
Figure 6B:
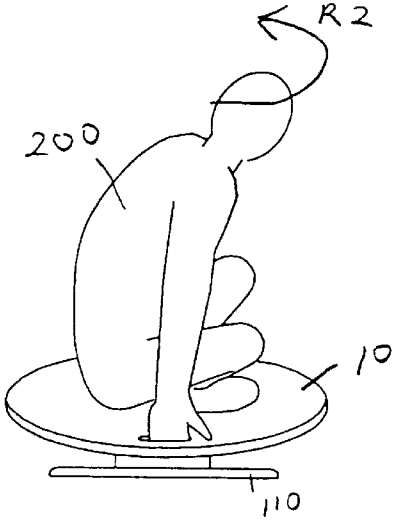
FIG. 6B shows the rider of FIG. 6A rotated ninety degrees in the direction of arrow R1, and tilted down to their right side at approximately 20 degrees from horizontal.
Figure 6C:
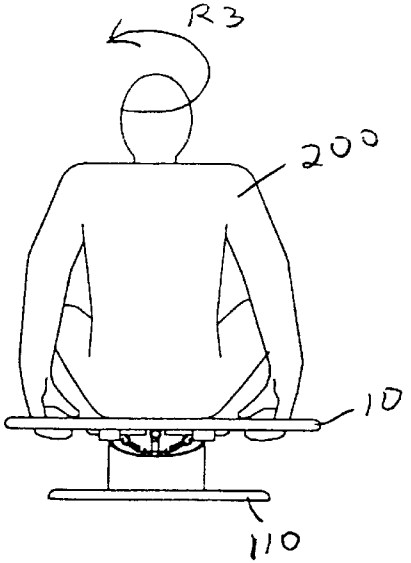
FIG. 6C shows the rider of FIG. 6A rotated approximately one hundred eighty degrees from the position shown in FIG. 6A and at a level orientation.
Figure 6D:
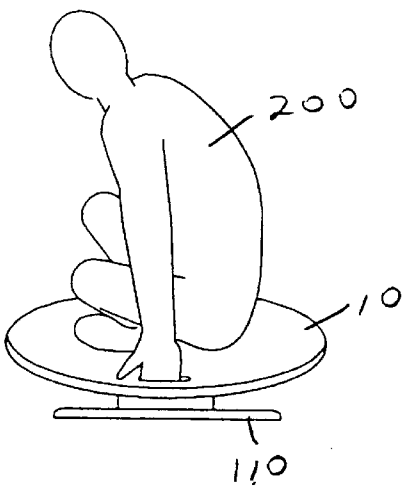
FIG. 6D shows the rider of FIG. 6A rotated approximately 270 degrees from the initial position shown in FIG. 6A and tilted down to their left side at approximately 20 degrees from horizontal.

The rider 200 can initiate the rotation of the seat 10 by leaning to either side to the positions shown in FIGS. 6A–6D. FIG. 6A shows the rider 200 on the rotatable pedestal in the front view position of FIG. 3 at 0 degree rotation and initial level orientation where seat 10 is parallel to disc shaped ground coupler 110. FIG. 6B shows the rider 200 of FIG. 6A rotated ninety degrees in the direction of arrow R1, and tilted down to their right side at approximately 20 degrees from horizontal, so that one edge of seat 10 becomes close to one edge of the ground coupler 110. FIG. 6C shows the rider 200 of FIG. 6A rotated approximately one hundred eighty degrees from the position shown in FIG. 6A and at a level orientation with seat 10 parallel to ground coupler 110. FIG. 6D shows the rider 200 of FIG. 6A rotated approximately 270 degrees from the initial position shown in FIG. 6A and tilted down to their left side at approximately 20 degrees from horizontal, so that another edge of seat 10 becomes close to another edge of ground coupler 110.

Figure 7B:
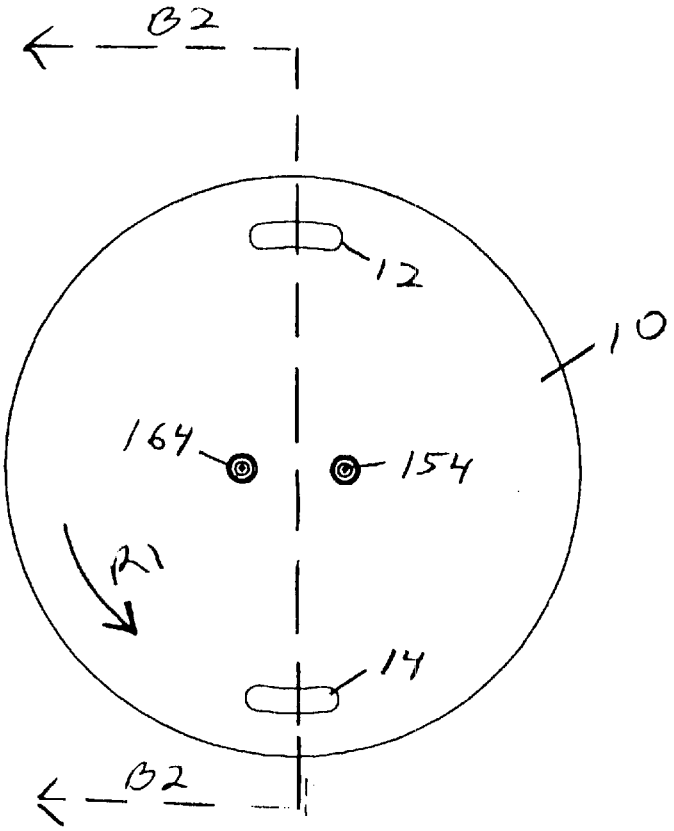
FIG. 7B shows a top view of the loaded down level pedestal of FIGS. 6A and 6C.
Figure 7A:
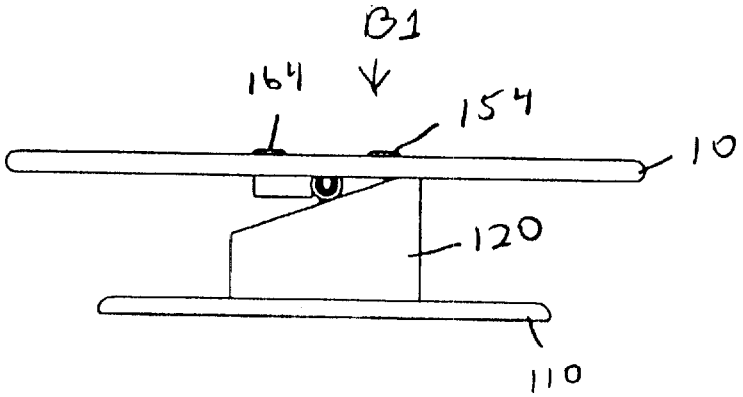
FIG. 7A is a side view of the pedestal of FIG. 7A along arrow B1.

FIG. 7B shows a top view of the loaded down level pedestal 1 of FIGS. 6A and 6C. FIG. 7A is a side view of the pedestal 1 of FIG. 7A along arrow B1. FIG. 7C is an enlarged side cross-sectional view of the pedestal 1 of FIG. 7A along arrow B2. Referring to FIGS. 7A–7C, seat 10 is positioned parallel to ground coupler 110 with rollers 135, 145 positioned on midway height edge 125 on the upper surface of cylindrical stand 120. Post leg 176 can rotate in the direction of arrow Q within the slot opening 129 within gimbal type support housing 128. Springs 182, 186 have inside ends attached to spring mount coupler 178, and opposite ends attached to hooks 136, 146 that are attached to axles 130, 140 and respective axle fasteners 134, 144. As can be seen in FIG. 7C, post leg 176 is substantially perpendicular to axles 130, 140, and springs 182 and 186 are substantially equally elongated in nonstretched positions.

FIG. 8A shows a side view of the loaded down tilted pedestal 1 of FIGS. 6B and 6D. FIG. 8B is a top view of the pedestal 1 of FIG. 8A along arrow C1. FIG. 8C is an enlarged side cross-sectional view of the pedestal 1 of FIG. 8A along arrow C2.

Referring to FIGS. 8A, 8B and 8C, the seat 10 shown in FIG. 7B has rotated approximately 90 degrees in the direction of arrow R1 where roller 145 abuts against upper edge 124 of cylindrical stand 120, while roller 135 abuts against lower upper edge 126 of cylindrical stand 120, and seat 10 is angled with handle 12 approximately 20 degrees from the horizontal position shown in FIGS. 7A, 7C. Spring 186 has now gone to a fully stretched position, while spring 182 is in a compressed position. Additionally, post leg 176 has moved from a perpendicular position to axles 130, 140 to an angle of approximately 70 degrees to axle 130 and approximately 110 degrees to axle 140.

When the seat 10 rotates 90 degrees more in the direction of arrow R2 shown in FIG. 6B to the parallel position shown in FIG. 6C, the position of the internal components is equivalent to that shown in FIG. 7C. Finally, when the seat 10 rotates 90 degrees more in the direction of arrow R3 shown in FIG. 6C to the tilted position shown in FIG. 6D, the position of the internal components is similar to that shown in FIG. 8C, with the exception that the spring 182 is stretched and spring 186 is compressed. As previously described, the rider 200 can initiate the rotation of the seat 10 by leaning to one side, and then vice versa. The rider 200 moving from the horizontal seated position to the tilted position causes the springs 182, 186 to compress and stretch which causes the rotating seat to rotate in a jumpy erratic rotational speed.

While the preferred embodiment has the rider seated, the user can play on the pedestal by standing on it and balancing themselves such that the leaning to one side is done by putting the user's body weight to one leg and alternating back to the other leg during the ride.

Although the preferred embodiment describes a planar disc shaped seat, the invention can be practiced with other seat shapes such as rectangular, triangular, and the like.

While the preferred embodiment describes using two springs, the invention can be practiced with other types of elastic members such as but not limited to bungee type cords, rubber type bands, and the like. Additionally, one spring type member can be used, and more than two spring type members can be used to vary the erratic rotation of the seat in use.

Although the preferred embodiment describes using a single sloped surface for the base stand, the invention can be used with an uneven surface having more than one slope such as a rounded concave surface edge, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A rotatable pedestal for child play, comprising:

a base having an upper portion and a lower portion, the lower portion for being positioned on a ground surface; a seat having an upper planar surface without armrests nor a backing, and a lower surface, the upper surface for allowing a user to sit thereon; and rotatable means for connecting the upper portion of the base to the lower surface of the seat, and for allowing the seat to rotate relative to the base, the rotatable means includes a first roller having a first axle mounted to the lower surface of the seat, the first roller having a surface edge that abuts against and rotates about the upper portion of the base.

2. The rotatable pedestal of claim 1, wherein the upper portion of the base includes: an uneven surface.

3. The rotatable pedestal of claim 2, wherein the uneven surface includes: a sloped surface having an angle of approximately 20 to approximately 30 degrees.

4. The rotatable pedestal of claim 3, wherein the angle is approximately 20 degrees.

5. The rotatable pedestal of claim 1, further comprising:

a first elastic member having one end attached adjacent to the first axle, and a second end attached to one side of the lower longitudinal stem end, wherein the first elastic member goes from a stretched position to a compressed position while the seat is being rotated causing the seat to rotate in an erratic manner.

6. The rotatable pedestal of claim 5, further comprising:

a second elastic member having one end attached adjacent to the second axle, and a second end attached to a second side of the lower longitudinal stem end, the second side being on an opposite side surface to the first side, wherein the first elastic member and the second elastic member each alternate between a stretched position and a compressed position while the seat is being rotated.

7. The rotatable pedestal of claim 6, wherein the first elastic member and the second elastic member include:

springs.

8. The rotatable pedestal of claim 1, wherein the seat includes: a disc shape, having hand grips.

9. The rotatable pedestal of claim 8, wherein the hand-grips include:

through-holes in the seat.

10. A rotatable pedestal for a use as a toy, comprising:

a base stand having an upper portion with an uneven upper surface, and a lower portion, the lower portion for being positioned on a ground surface;

a seat attached to the base stand, the seat having an upper surface for supporting a user sitting thereon and a lower surface, rotatable means for rotating the seat about the uneven upper surface of the base stand; and a spring means attached to the base stand and the seat, the spring means going from a stretched position to a compressed position while the seat is rotating and the spring means causing the seat to rotate in an erratic manner while the seat is rotating, the rotatable means includes a first roller having a first axle mounted to the lower surface of the seat, the first roller having a surface edge that abuts against and rotates about the upper portion of the base, the rotatable means includes a post having an upper t-shaped end and a lower longitudinal stem end, the upper t-shaped end being rotatably attached to a lower mount member on the lower surface of the seat, the lower longitudinal stem end being rotatably attached to the base, the upper t-shaped end having a rotational axis perpendicular to the rotational axis of the first roller.

11. A rotatable pedestal for play, comprising:

a base having an upper portion and a lower portion, the lower portion for being positioned on a ground surface;

a seat having an upper planar surface for allowing a user to sit thereon and a lower surface; and a rotatable means for connecting the upper portion of the base to the lower surface of the seat, and for allowing the seat to rotate relative to the base, the rotatable means includes a first roller having a first axle mounted to the lower surface of the seat, the first roller having a surface edge that abuts against and rotates about the upper portion of the base, and the rotatable means includes a post having an upper t-shaped end and a lower longitudinal stem end, the upper t-shaped end being rotatably attached to a lower mount member on the lower surface of the seat, the lower longitudinal stem end being rotatably attached to the base, the upper t-shaped end having a rotational axis perpendicular to the rotational axis of the first wheel.

* * * * *